US010203135B2

(12) United States Patent
Xu

(10) Patent No.: US 10,203,135 B2
(45) Date of Patent: Feb. 12, 2019

(54) REGENERATIVE REFRIGERATOR

(71) Applicant: SUMITOMO HEAVY INDUSTRIES, LTD., Tokyo (JP)

(72) Inventor: Mingyao Xu, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 15/672,449

(22) Filed: Aug. 9, 2017

(65) Prior Publication Data

US 2017/0336107 A1 Nov. 23, 2017

Related U.S. Application Data

(62) Division of application No. 13/871,100, filed on Apr. 26, 2013, now abandoned.

(30) Foreign Application Priority Data

Jul. 20, 2012 (JP) ..... 2012-161531

(51) Int. Cl.
*F25B 9/00* (2006.01)
*F25B 9/14* (2006.01)

(52) U.S. Cl.
CPC ..... *F25B 9/14* (2013.01); *F25B 2309/003* (2013.01)

(58) Field of Classification Search
CPC ..... F25B 9/14; F25B 9/145; F25B 2309/003; F25B 2309/1415; F25B 2309/1416
USPC ..... 62/6
See application file for complete search history.

(56) References Cited

U.S. PATENT DOCUMENTS

| | | | | |
|---|---|---|---|---|
| 2,564,100 | A | 8/1951 | Du Pre Frits Karel | |
| 6,475,935 | B1 | 11/2002 | Ishizaki et al. | |
| 2007/0130961 | A1 | 6/2007 | Xu et al. | |
| 2008/0104967 | A1 * | 5/2008 | Satoh | C09K 5/14 62/6 |
| 2009/0302844 | A1 | 12/2009 | Saito et al. | |
| 2012/0151912 | A1 | 6/2012 | Yamashita et al. | |

FOREIGN PATENT DOCUMENTS

| | | | |
|---|---|---|---|
| JP | 03129257 | A * | 6/1991 |
| JP | H03-158661 | | 7/1991 |
| JP | H06-074586 | | 3/1994 |
| JP | H06-207754 | | 7/1994 |
| JP | H07-324831 | | 12/1995 |
| JP | 2007-155319 | | 6/2007 |
| JP | 2008-224161 | | 9/2008 |
| JP | 2012-237478 | | 12/2012 |

* cited by examiner

*Primary Examiner* — Joseph Trpisovsky
(74) *Attorney, Agent, or Firm* — IPUSA, PLLC

(57) ABSTRACT

A disclosed regenerative refrigerator including a regenerator filled with a regenerative material for accumulating cooling of a refrigerant gas, wherein the regenerator is divided into a central region and a peripheral region on a cross-sectional face of the regenerator, and a specific heat of the central region is larger than a specific heat of the peripheral region.

6 Claims, 7 Drawing Sheets

REGENERATIVE REFRIGERATOR

CROSS-REFERENCE TO RELATED APPLICATIONS

This patent application is a divisional application of and claims the benefit of priority under 35 U.S.C. 120 of U.S. patent application Ser. No. 13/871,100 filed on Apr. 26, 2013, which is based upon and claims the benefit of priority of Japanese Priority Patent Application No. 2012-161531 filed on Jul. 20, 2012, the entire contents of which are incorporated herein by reference.

BACKGROUND

1. Technical Field

The present invention generally relates to a regenerative refrigerator.

2. Description of the Related Art

In general, a Gifford-McMahon (GM) refrigerator, a pulse tube refrigerator, or the like is known as a regenerative refrigerator for cooling an object by an adiabatic expansion of a refrigerant gas and accumulating cooling generated by the adiabatic expansion of the refrigerant gas. These regenerative refrigerators include a regenerator for accumulating cooling generated when the refrigerant gas is adiabatically expanded. A regenerative material is filled in the regenerator in order to accumulate cooling. For example, lead is used as the regenerative material.

SUMMARY

One aspect of the embodiments of the present invention may be to provide a regenerative refrigerator including a regenerator filled with a regenerative material for accumulating cooling of a refrigerant gas, wherein the regenerator is divided into a central region and a peripheral region on a cross-sectional face of the regenerator, and a specific heat of the central region is larger than a specific heat of the peripheral region.

Objects and advantages of the embodiments are set forth in part in the description which follows, and in part will become obvious from the description, or may be learned by practice of the invention. The objects and advantages of the invention will be realized and attained by means of the elements and combinations particularly pointed out in the appended claims. It is to be understood that both the foregoing general description and the following detailed description are exemplary and explanatory and are not restrictive of the invention as claimed.

DETAILED DESCRIPTION

In a regenerative refrigerator realizing an ultralow temperature of 30K or less, the specific heat of lead suddenly decreases along with a decrement of a temperature in a temperature range of 15K or less. The regenerative effect may not be sufficient when lead is used as a regenerative material.

Then, it is possible to use a magnetic regenerative material such as $HoCu_2$ or the like having a specific heat larger than that of lead in the temperature range of 30K or less. A magnetic regenerative material shows phase transition in a temperature range of 15K or less so as to change to an anti-ferromagnetic material. Because the magnetic regenerative material has a magnetic susceptibility larger than lead or the like, high-efficiency regenerative effect is possible.

However, the magnetic regenerative material is mainly made of a rare-earth material. Therefore, it is difficult to obtain the magnetic regenerative material and the cost of the magnetic regenerative material is high.

The embodiments are provided in consideration of the above problems. One object of the embodiments is to provide a regenerative refrigerator which can provide a high-efficiency regenerative effect at a low cost.

In the disclosed regenerative refrigerator, a specific heat in a central region where the flow rate of a refrigerant gas is high is increased to be larger than the specific heat in a peripheral region where the flow rate of a refrigerant gas is low. Therefore, the regenerator efficiency can be enhanced.

A description is given below, with reference to the FIG. 1 through FIG. 7C of embodiments of the present invention. Where the same reference symbols are attached to the same parts, repeated description of the parts is omitted.

First Embodiment

Figure 1:
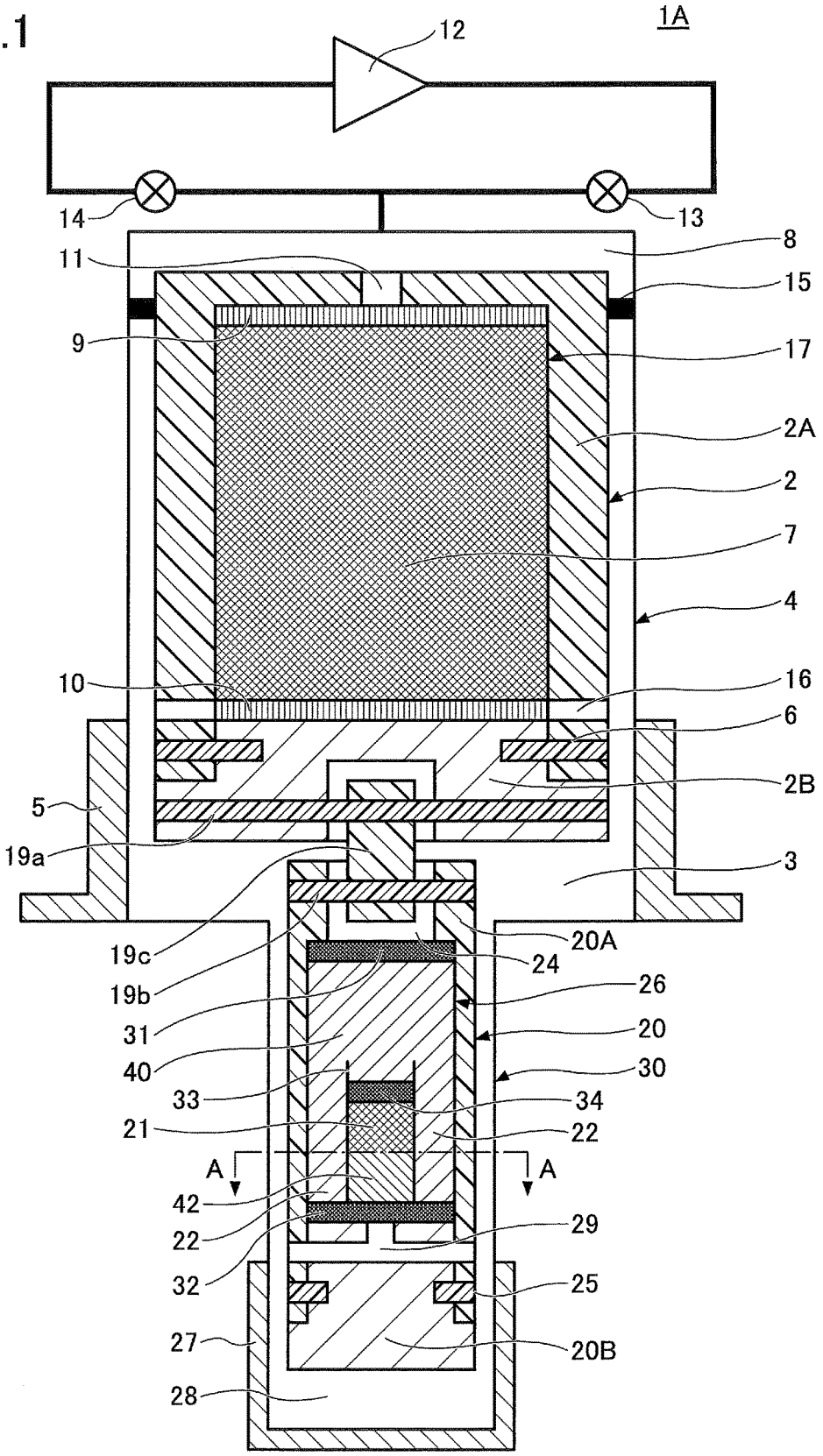
FIG. 1 schematically illustrates the inside of a regenerative refrigerator of a first embodiment.

FIG. 1 is a cross-sectional view of a regenerative refrigerator of a first embodiment. Within the first embodiment, a two-stage Gifford-McMahon (GM) refrigerator using a helium gas as a refrigerant gas is exemplified as a regenerative refrigerator 1A. However, the first embodiments are applied to not only the GM refrigerator but also various refrigerators (for example, a pulse tube refrigerator or the like) which have a regenerator filled with a regenerative material.

The regenerative refrigerator 1A includes a first stage displacer 2, a second stage displacer 20, a first stage cylinder 4, a second stage cylinder 30, a first stage cooling stage 5, a second stage cooling stage 27, a first stage regenerator 17, a second stage regenerator 26, a compressor 12, and so on.

The first stage displacer 2 has a cylindrical shape. The first stage displacer 2 includes a first stage displacer main body 2A, a first stage heat exchanging portion 2B, a first stage regenerator 17, and so on. The first stage displacer main body 2A is shaped like a cylinder having a bottom. A regenerative material 7 is filled in the first stage displacer main body 2A. The first stage regenerator 17, which is filled with the regenerative material 7, is provided. The regenerative material 7 may be made of lead, copper, or the like having a large specific heat (a volumetric specific heat) in a temperature range of 15K or higher.

A flow smoother 9 is provided on the high temperature side of the first stage regenerator 17 in order to control a flow of a refrigerant gas. In FIG. 1, the upper side corresponds to the high temperature side. A flow smoother 10 is provided on the low temperature side of the first stage regenerator 17 in order to control the flow of the refrigerant gas. In FIG. 1, the lower side corresponds to the lower temperature side.

On a high temperature end of the first stage displacer 2, a first flow path 11 is formed to allow a refrigerant gas to flow from the room temperature chamber 8 to the first stage regenerator 17, which is formed on the high temperature side of the first stage displacer 2. The room temperature chamber 8 is a space formed between the upper surface of the first stage cylinder 4 and the upper surface of the first stage displacer 2. A supply and discharge system (described later) is connected to the room temperature chamber 8.

On a low temperature end of the first stage displacer 2, a first stage heat exchanging portion 2B is provided. Between the first stage displacer main body 2A and the first stage heat exchanging portion 2B, a second flow path 16 is formed to connect the first stage regenerator 17 to a first stage expansion space 3. The first stage heat exchanging portion 2B is connected to the first stage displacer 2 using a pin 6.

The first stage expansion space 3 is a space formed between the lower surface of the first stage cylinder 4 and the lower surface of the first stage heat exchanging portion 2B (first stage displacer 2). A high pressure refrigerant gas is introduced into the first stage expansion space 3 via the second flow path 16. A first stage cooling stage 5 is provided at a position corresponding to the first stage expansion space 3 of the first stage cylinder 4.

The above first stage displacer 2 is installed in the first stage cylinder 4. A driving mechanism (not illustrated) such as a scotch yoke mechanism is connected to the high temperature end of the first stage displacer 2. With the above scotch yoke mechanism, the first stage displacer 2 reciprocates in the first stage cylinder 4 by the scotch yoke mechanism.

A seal 15 is installed at a predetermined position between the first stage displacer 2 and a top flange. The seal 15 hermetically divides the first stage expansion space 3 from a room temperature chamber 8.

The second stage cylinder 30 is integrally formed on a low temperature end portion of the first stage cylinder 4. The second stage cylinder 30 accommodates the second stage displacer 20 so that the second stage displacer 20 is movable in the second stage cylinder 30.

The second stage displacer 20 is in a cylindrical shape and is connected to the low temperature end portion of the first stage displacer 2. Specifically, a pin 19*a* is installed in the low temperature end of the first stage heat exchanging portion 2B. A pin 19*b* is installed in the high temperature end of the second stage displacer 20. The pins 19*a* and 19*b* are connected by a connector 19*c*. Thus, the second stage displacer 20 is connected to the first stage displacer 2.

Therefore, while the first stage displacer 2 reciprocates inside the first stage cylinder 4 by the scotch yoke mechanism, the second stage displacer 20 also reciprocates in the second stage cylinder 30 along with the reciprocation of the first stage displacer 2.

The second stage displacer 20 includes a second stage displacer main body 20A, a second stage heat exchanging portion 20B, a second stage regenerator 26, and so on. A second stage displacer main body 20A is in a cylindrical shape having a bottom, and has a second stage regenerator 26 in the second stage displacer main body 20A. The above second stage displacer 2 is installed in the second stage cylinder 30.

On the high temperature end of the second stage displacer 20, a third flow path 24 is formed to allow the refrigerant gas to flow from a first stage expansion space 3 to the second stage regenerator 26 formed on the high temperature side of the second stage displacer 20. On a low temperature end of the second stage displacer 2, the second stage heat exchanging portion 20B is installed. Between the second stage displacer main body 20A and the second stage heat exchanging portion 20B, a fourth flow path 29 is formed to connect the second stage regenerator 26 to a second stage expansion space 28.

The second stage expansion space 28 is a space formed between the lower surface of the second stage cylinder 30 and the lower surface of the second stage heat exchanging portion 20B (second stage displacer 20). A high pressure refrigerant gas is introduced into the second stage expansion space 28 via the fourth flow path 29. A second stage cooling stage 27 is provided at a position corresponding to the second stage expansion space 28 of the second stage cylinder 30.

The supply and discharge system includes a compressor 12, a supply valve 13, a return valve 14, and so on. When the supply valve 13 is opened and simultaneously the return valve 14 is closed, a high pressure refrigerant gas, which is generated by the compressor 12, is supplied into a room temperature chamber 8. In an opposite manner, when the supply valve 13 is closed and simultaneously the return valve 14 is opened, a low pressure refrigerant gas flows back into the compressor 12.

Next, operations of the above described regenerative refrigerator 1A are described.

When the supply valve 13 is opened while the first and second stage displacers 2 and 20 are at the lower dead ends, the refrigerant gas from the compressor 12 flows into the first stage regenerator 17 via the room temperature chamber 8 and the first flow path 11. The high pressure refrigerant gas, which is cooled by exchanging heat with the regenerative material 7 in the first stage regenerator 17, is supplied into the first stage expansion space 3 via the second flow path 16.

The refrigerant gas supplied to the first stage expansion space 3 flows into the second stage regenerator 26 via the third flow path 24. The refrigerant gas exchanges heat with regenerative materials 40 and 42 (described below) so as to be cooled and is supplied to the second stage expansion space 28 via the fourth flow path 29.

Under the condition, the first and second stage displacers 2, 20 are moved toward the upper dead end by the scotch yoke mechanism. With this, the volumes of the first and second stage expansion spaces 3 and 28 are increased. At this time, the refrigerant gas continues to be supplied to the first and second stage expansion spaces 3 and 28 via the first and second regenerators 17 and 26.

When the first and second stage displacers 2 and 20 move in the vicinity of the upper dead end, the supply valve 13 is closed and the return valve 14 is opened. With this, the refrigerant gas expands in the first and second stage expansion spaces 3 and 28 thereby generating cooling.

The expanded refrigerant gas flows back to a low pressure side of the compressor 12 via the first and second stage regenerators 17 and 26 and the flow paths 11, 16, 24, and 29. At this time, the regenerative materials 7, 40, and 42 in the first and second regenerators 17 and 26 accumulate cooling of the refrigerant gas.

While the return valve 14 is maintained to be opened and the supply valve 13 is maintained to be closed, the first and second stage displacers 2 and 20 move toward the lower dead end.

By repeating a cycle of the above operations, the first stage expansion space 3 is cooled to be, for example, about 40K and the second stage expansion space is cooled to be, for example, about 4K.

Referring to FIGS. 1 to 3B, the second stage regenerator 26 provided in the second stage displacer 20 is described in detail.

Figure 2:
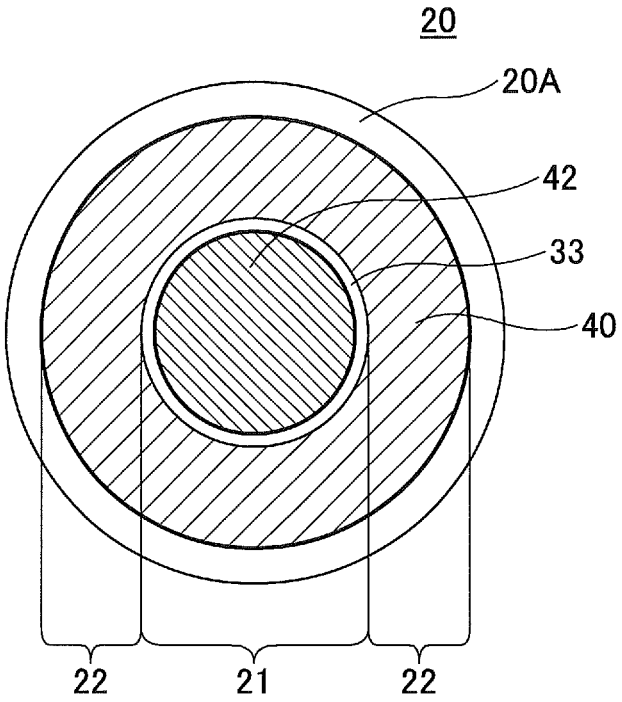
FIG. 2 is a cross-sectional view taken along a line A-A of FIG. 1.

FIG. 2 is a cross-sectional view of the second stage displacer 20 illustrated in FIG. 1 taken along a line A-A. FIG. 3 illustrates a flow distribution of the refrigerant gas flowing through the second stage displacer 20.

Referring to FIG. 1, the second stage regenerator 26 has a separating member 31 on the high temperature side and a separating member 32 on the low temperature side. The regenerative materials 40 and 42 fill a space formed by the separating members 31 and 32. Although the separating members 31 and 32 prevent the regenerative materials 40 and 42 from flowing therethrough, the refrigerant gas can freely pass through the separating members 31 and 32.

Within the first embodiment, a cross-sectional face of the second stage regenerator 26 is divided into a central region 21, which is shaped substantially like a circle and positioned in the vicinity of the center, and a peripheral region 22, which is shaped like a ring and positioned around the central region 21.

Here, a flow rate of the refrigerant gas in the second stage regenerator 26 is described. As described above, when the regenerative refrigerator 1A cools an object, the refrigerant gas flows through the inside of the second stage displacer 20. While the supply valve 13 is opened, the refrigerant gas flows through the high temperature end to the low temperature end inside the second stage displacer 20 (in the downward direction in FIGS. 1 and 3B). While the return valve 14 is opened, the refrigerant gas flows through the low temperature end to the high temperature end inside the second stage displacer 20 (in the upward direction in FIGS. 1 and 3A).

Figure 3A:
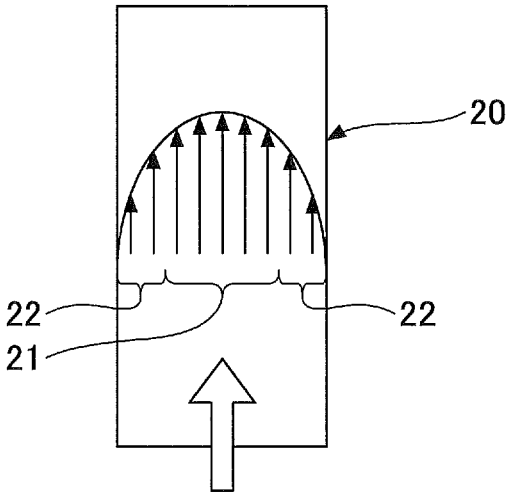
FIGS. 3A and 3B illustrate flow rate distribution of a refrigerant gas inside a second stage displacer.
Figure 3B:
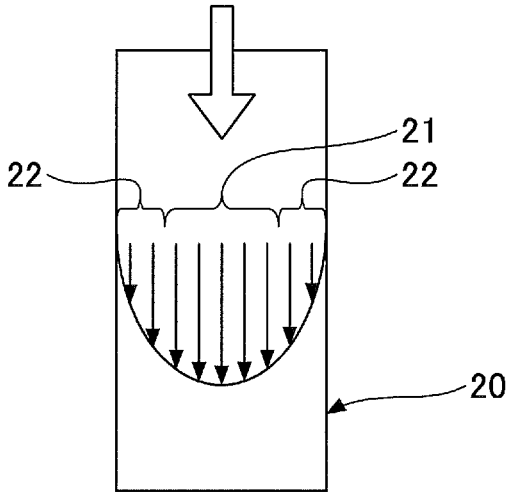

FIG. 3A illustrates a flow distribution of the refrigerant gas inside the second stage displacer 20 from the low temperature end to the high temperature end. FIG. 3B illustrates a flow distribution of the refrigerant gas inside the second stage displacer 20 from the high temperature end to the low temperature end. The lengths of arrows in FIGS. 3A and 3B correspond to the flow rates of the refrigerant gas flowing in the second stage regenerator 26.

Referring to FIGS. 3A and 3B, the flow distribution of the refrigerant gas flowing through the second stage displacer 20 is not even in a flowing direction of the refrigerant gas.

In other words, on the cross-sectional face of the second stage displacer, the flow rate (hereinafter, a "central region flow rate") of the refrigerant gas is larger in the central region 21 of second stage displacer 20. Meanwhile, the flow rate (hereinafter, a "peripheral region flow rate") of the refrigerant gas on the peripheral region 22 is less than that of the central region 21 of the second stage displacer 20. This is because the flow path resistance of the refrigerant gas on the central region 21 is less than the flow path resistance of the refrigerant gas on the peripheral region 22.

Within the first embodiment, in association with the flow distribution of the refrigerant gas inside the second stage regenerator 26, the second stage displacer 20 is divided into the central region 21 and the peripheral region 22 on the cross-sectional face. Specifically, by dividing the separating member 33 (corresponding to a separating member recited in claims) in the above cylindrical shape, which is provided in a boundary between the central region 21 and the peripheral region 22, to thereby divide the central region 21 and the peripheral region 22.

The separating member 33 is provided in an upper portion of the separating member 32, which is provided on the low temperature end side inside the second stage regenerator 26. The separating member 33 allows the refrigerant gas to pass through in a manner similar to other separating members 31 and 32. However, the separating member 33 prevents the regenerative material from passing through.

On the other hand, within the first embodiment, two types of the nonmagnetic regenerative material 40 and the magnetic regenerative material 42 are used as the regenerative material filling the second stage regenerator 26. Within the first embodiment, bismuth or an alloy containing bismuth is used as the nonmagnetic regenerative material 40. $HoCu_2$ is used as the magnetic regenerative material 42.

The magnetic regenerative material 42 such as $HoCu_2$ has a specific heat (a volumetric specific heat) larger than the nonmagnetic regenerative material 40 such as bismuth under an ultralow temperature of 30K or less. The second stage displacer 20 has an ultralow temperature of 15K or less when the regenerative refrigerator 1A operates. Therefore, when the regenerative refrigerator 1A operates, the second stage regenerator 26 has a temperature of 30K or less. The magnetic regenerative material 42 has specific heat larger than the specific heat of the nonmagnetic regenerative material 40.

Within the first embodiment, the magnetic material 42 having a larger specific heat is provided in the central region 21. The magnetic material 40 having a less specific heat than that of the magnetic regenerative material 42 is provided in the peripheral region 22. Therefore, the specific heat of the central region 21 becomes larger than the specific heat of the peripheral region 22.

As described, within the first embodiment, because the magnetic regenerative material 42 having a large specific heat is provided in the central region where the flow rate of the refrigerant gas is large, it is possible to enhance an efficiency of accumulating cooling of the second stage regenerator 26.

Because the magnetic regenerative material 42 is provided only in the central region 21, the filling amount (the amount to use) of the magnetic regenerative material 42 can be reduced in comparison with the structure in which the magnetic regenerative material 42 is provided in the entire second stage regenerator.

Thus, a sufficient cold accumulating capability can be obtained with less magnetic regenerative material, which is rare and expensive.

Further, in the first embodiment, the magnetic regenerative material 42 is provided in the central region 21 in the vicinity of the low temperature end. In a case where $HoCu_2$ is used as the magnetic regenerative material 42, the peak of the volume specific heat is as low as 5K to 10K. Therefore, an efficiency of accumulating cooling is high by providing $HoCu_2$ on the low temperature end in the central region 21.

Within the first embodiment, the height of the separating member 33 separating the nonmagnetic regenerative material 40 from the magnetic regenerative material 42 is set to be less than the overall height of the second stage regenerator 26. The magnetic regenerative material 42 is provided only in the vicinity of the low temperature end. The separating member 34 is provided in the upper portion of the magnetic regenerative material 42, which fills the inside of the separating member 33, so that the nonmagnetic regenerative material 40 is not mixed with the magnetic regenerative material 42. With this structure, the amount of the magnetic regenerative material 42 to be used can be reduced while maintaining heat exchanging efficiency with the refrigerant gas.

Within the first embodiment, bismuth is used as the nonmagnetic regenerative material 40, and $HoCu_2$ or the like is used as the magnetic regenerative material 42. However, the materials of the nonmagnetic regenerative material 40 and the magnetic regenerative material 42 are not limited to these. Other materials may be used. At this time, the magnetic regenerative material 42 is preferably made of a material having a peak of the specific heat at 30K or less. Further, the nonmagnetic regenerative material 40 is preferably made of lead instead of bismuth or the like. However, in consideration of the environment, it is preferable to use bismuth or the like.

For example, a ratio between cross-sectional areas of the central and peripheral regions is appropriately selected depending on the capability and the size of the refrigerator. It is preferable that the central region occupies from about 50% to about 95%.

Further, when the regenerative materials 40 and 42 fill the inside of the second stage regenerator 26, it is preferable to fill the regenerative materials 40 and 42 so that the pressure loss of the refrigerant gas flowing through the central region becomes greater than the pressure loss of the refrigerant gas flowing through the peripheral region.

Next, referring to FIGS. 4 to 7C, regenerative refrigerators 1B to 1D of second to fourth embodiments are described. Referring to FIGS. 4 to 7C, the same reference symbols are attached to the structures corresponding to the structures illustrated in FIGS. 1 to 3B and description of these portions is omitted.

Second Embodiment

Figure 4:
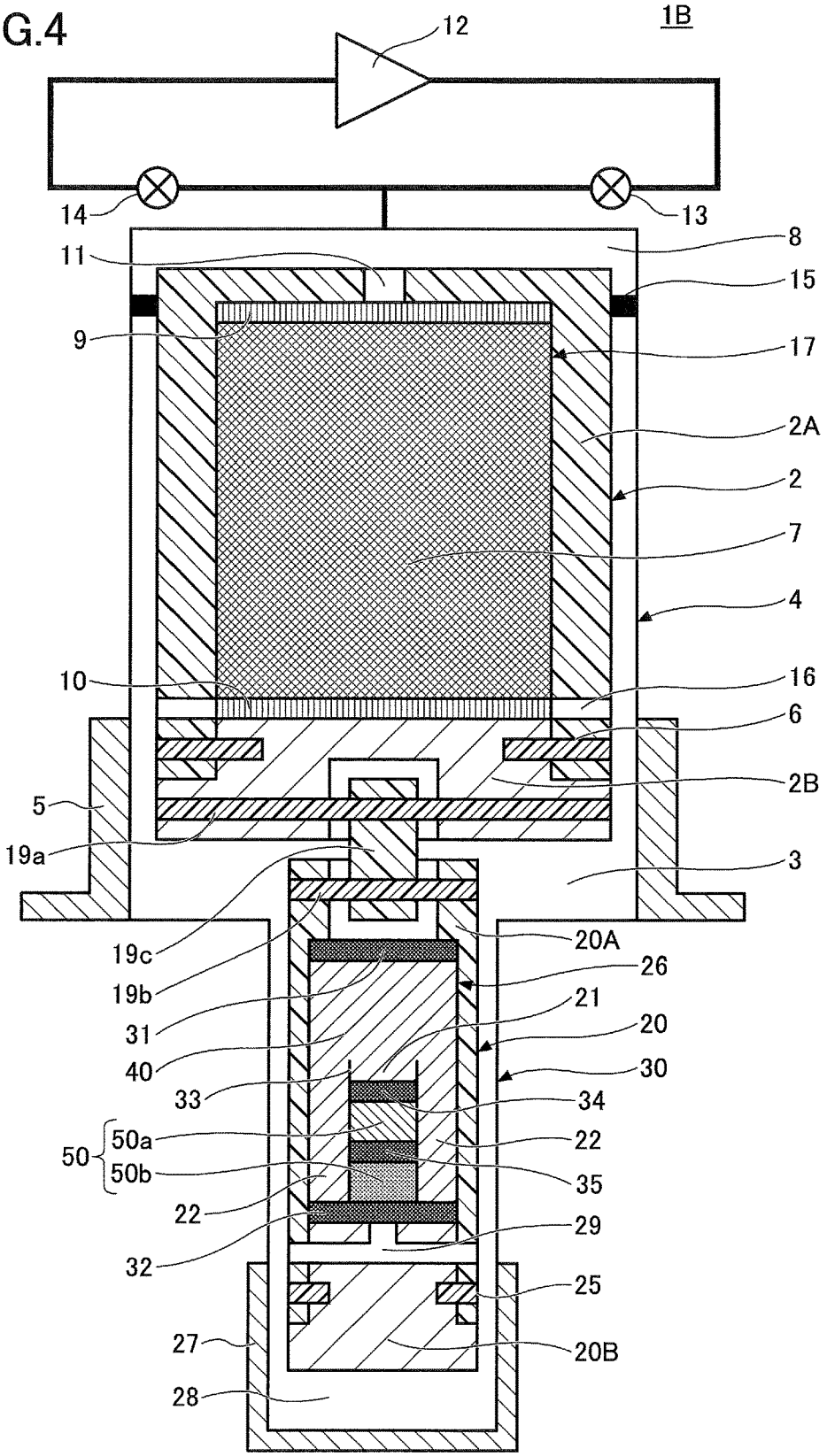
FIG. 4 schematically illustrates the inside of a regenerative refrigerator of a second embodiment.

FIG. 4 schematically illustrates a regenerative refrigerator 1B of the second embodiment. Within the first embodiment, only one type of the magnetic regenerative material 42 is arranged in the central region 21 in the regenerative refrigerator 1A of the above first embodiment. Within the second embodiment, two types of regenerative materials 50*a* and 50*b* are used as the regenerative material 50 having a peak of the specific heat at 30K or less. The regenerative materials 50*a* and 50*b* are laminated via a separating plate 35.

Specifically, $HoCu_2$ being the magnetic regenerative material used in the first embodiment is used as the first regenerative material 50*a*, which is positioned on the upper side. Meanwhile, GOS ($Cd_2O_2S$) being a ceramics regenerative material is used as the second regenerative material 50*b*, which is positioned on the lower side.

GOS has a specific heat of about two times of that of $HoCu_2$ in an ultralow temperature region of 4K to 5K. Therefore, the first and second regenerative materials 50*a* and 50*b* are arranged in the central region 21, and the second magnetic regenerative material 50*b* made of GOS is provided on the low temperature side of the position of providing the first magnetic regenerative material 50*a*. Then, it is possible to obtain a higher efficiency of accumulating cooling in the second embodiment than in the first embodiment.

Within the above second embodiment, GOS is used as the second regenerative material 50*b*, it is possible to use another regenerative material having a high specific heat peak in the ultralow temperature such as GAP ($GdAlO_3$) instead of GOS.

Figure 5:
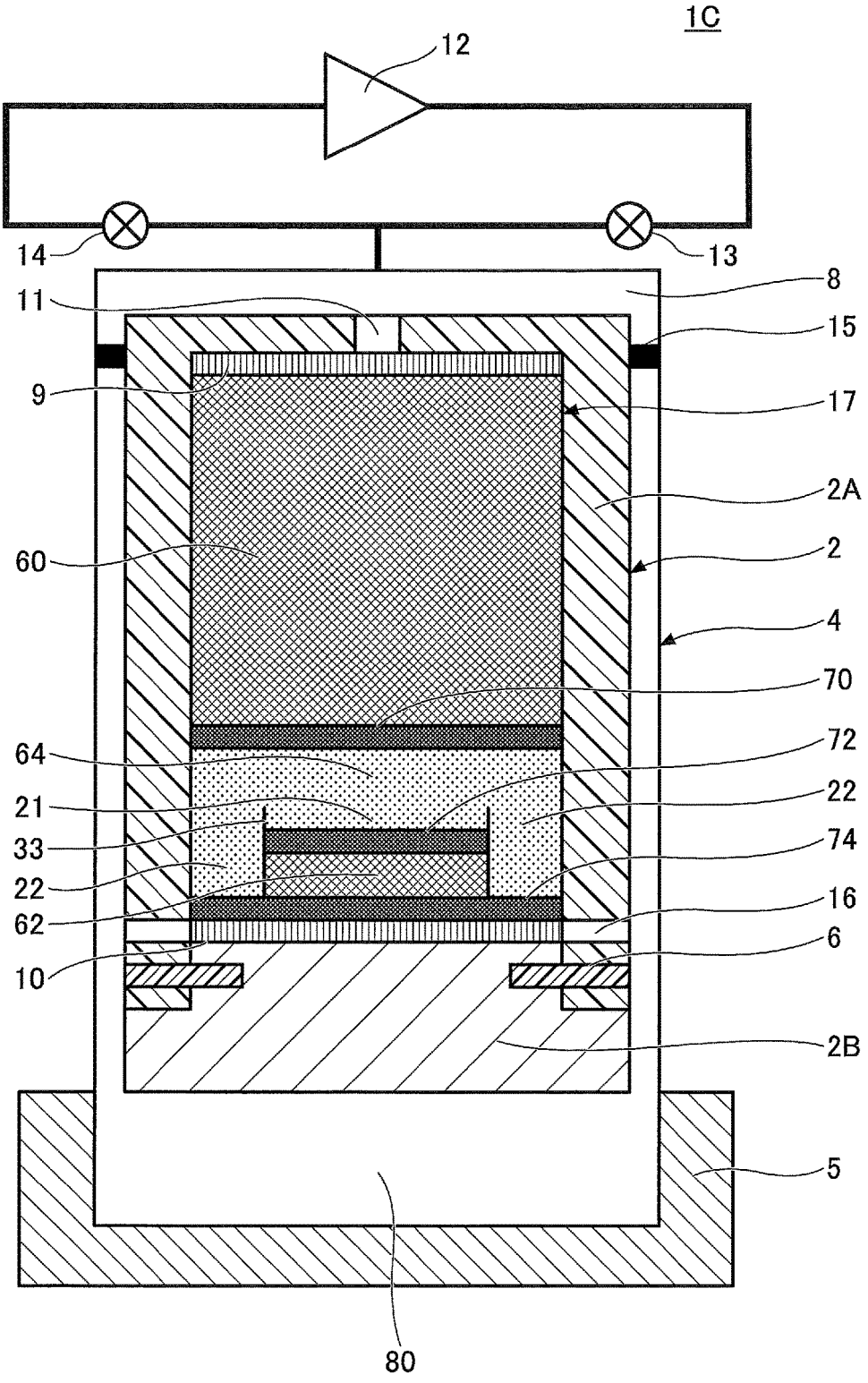
FIG. 5 schematically illustrates the inside of a regenerative refrigerator of a third embodiment.

FIG. 5 schematically illustrates a regenerative refrigerator 1C of the third embodiment.

Within the above first embodiment, a two-stage regenerative refrigerator 1A including two sets of the displacer, the cylinder, the regenerator and so on is illustrated. However, this patent application is not limited to the two-stage regenerative refrigerator.

Within the third embodiment, the magnetic regenerative material 62 is provided in the central region 21 of a single-stage regenerative refrigerator. A nonmagnetic regenerative material 64 is provided in the peripheral region 22 around the central region 21. In the single-stage regenerative refrigerator 1C, the regenerative materials 62 and 64 of two different types are used. The regenerative material 62 having a high specific heat is filled in the central region 21, and the regenerative material 64 having a low specific heat is filled in the peripheral region 22 to thereby perform an effect similar to the first embodiment.

The temperature inside the single-stage regenerative refrigerator 1C is higher than the temperature inside a multi-stage regenerative refrigerator. Therefore, in the single-stage regenerative refrigerator 1C, the regenerative material provided in the central region 21 is not limited to a magnetic regenerative material and may be a material having a lower specific heat than that of the magnetic regenerative material. Further, the nonmagnetic regenerative material other than the magnetic regenerative material may be filled in the central region 21.

For example, a ratio between cross-sectional areas of the central and peripheral regions is appropriately selected depending on the capability and the size of the refrigerator. It is preferable that the central region occupies from about 50% to about 95%.

Fourth Embodiment

Figure 6:
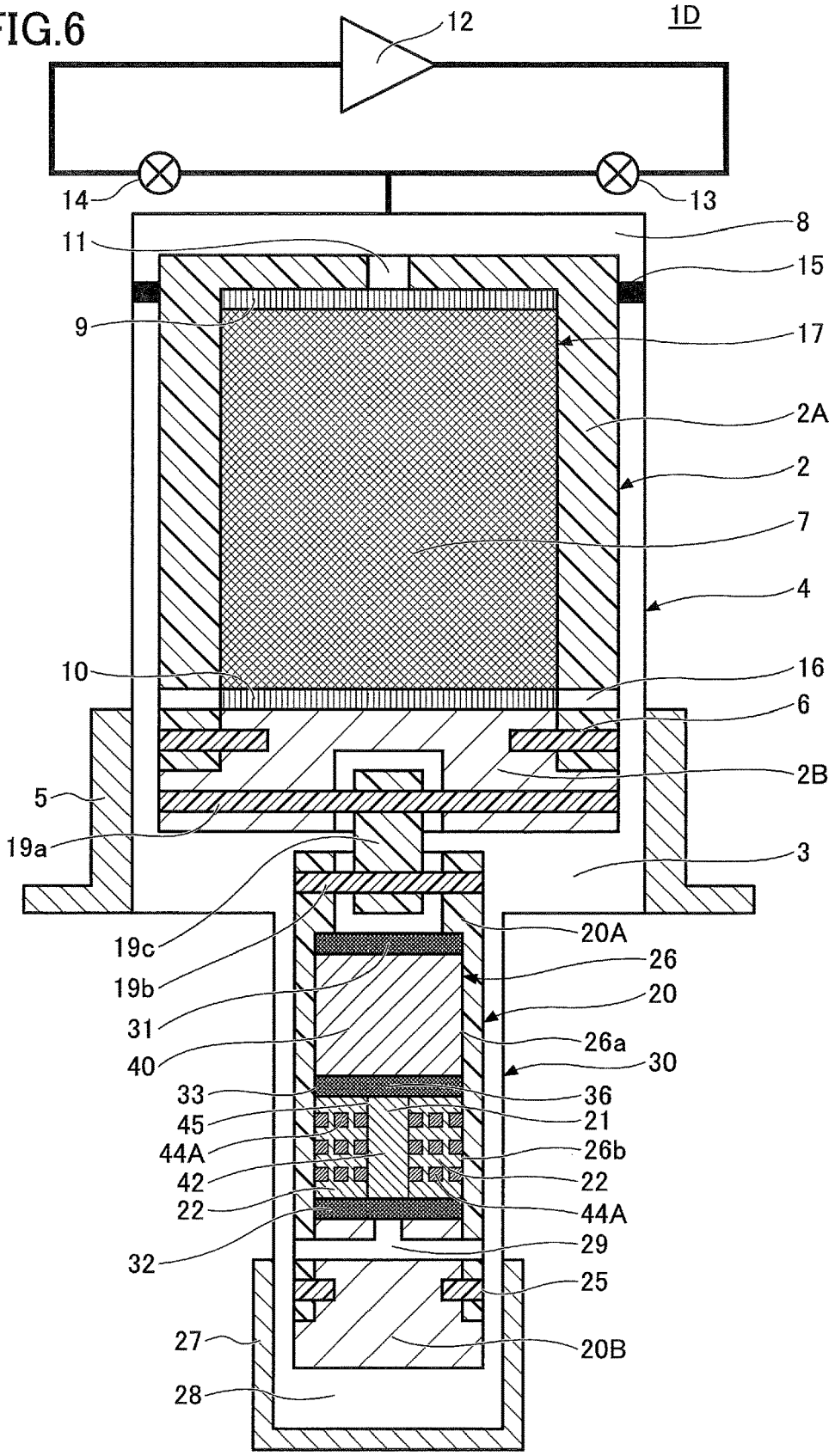
FIG. 6 schematically illustrates the inside of a regenerative refrigerator of a fourth embodiment.

FIG. 6 schematically illustrates a regenerative refrigerator of the fourth embodiment.

The regenerative refrigerator 1D is separated into the high and low temperature sides by providing a separating member 36 inside the second stage regenerator 26. The nonmagnetic regenerative material 40 fills the region on the high temperature side (hereinafter, a "high temperature region" 26*a*), and the magnetic regenerative material 42 fills the region on the low temperature side (hereinafter, a "low temperature region" 26*b*). Therefore, in the low temperature region 26*b* of the second regenerator 26, the magnetic regenerative material 42 is provided in both of the central region 21 and the peripheral region 22.

Figure 7A:
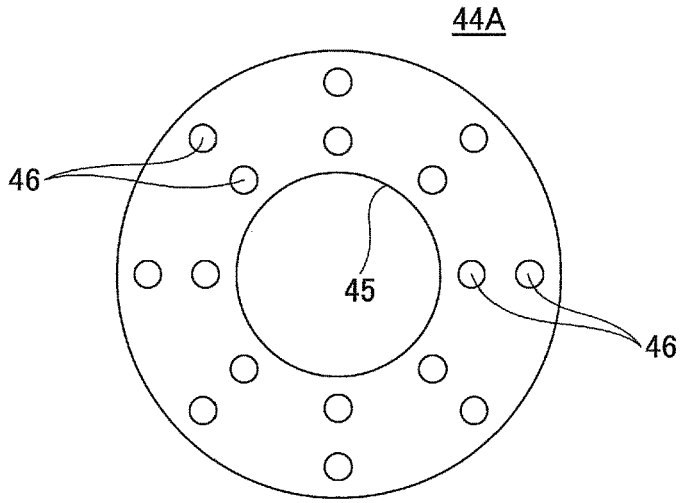
FIGS. 7A, 7B, and 7C are plan views for explaining a filler provided in a regenerative refrigerator of a fourth embodiment.

Further, in the fourth embodiment, a filler 44A is provided in the peripheral region 22 of the magnetic regenerative material 42 on the low temperature side. FIG. 7A is an enlarged view of the filler 44A.

The filler 44A is formed of a plate material made of copper, a copper alloy or the like having high heat conductivity. The filler 44A is in a ring shape (an annular shape) with a central hole 45 formed in the center. The diameter of the central hole 45 is substantially the same as the diameter of the central region 21. The outer diameter of the filler 44A is determined so that the filler 44A can be installed inside the second stage regenerator 26.

Further, plural through holes 46 are opened in the filler 44A. Within the fourth embodiment, 8 pairs of (two) through holes of the through holes 46 are opened in a radial pattern.

The diameters of the through holes 46 are set to be larger than a particle diameter of the magnetic regenerative material 42.

The above filler 44A is provided inside the second stage regenerator 26. At this time, the filler 44A is provided inside the second stage regenerator so as to be embedded in the regenerative material 42. Within the fourth embodiment, three sheets of the fillers 44A are piled with a predetermined gap inside the magnetic regenerative material 42. However, the number of the fillers 44A filling the inside of the magnetic regenerative material 42 is not limited to the above and can be appropriately selected.

As described, the central hole 45 is opened in the filler 44A. By providing the filler 44A inside the magnetic regenerative material 42, the filler 44A is provided substantially in the peripheral region 22.

Here, a filling rate of the magnetic regenerative material inside the low temperature region 26*b* is described. In the low temperature region 26*b*, the filler 44A is provided (embedded). Therefore, the filling amount of the magnetic regenerative material 42 is decreased by the volume of the filler 44A.

The filling rate of the magnetic regenerative material 42 in the central region 21 inside the low temperature region 26*b* is higher because the central hole 45 is opened in the center of the filler 44A corresponding to the central region 21. Meanwhile, the filling rate of the magnetic regenerative material 42 in the peripheral region 22 is lower than in the central region 21 because the filler 44A exists in the peripheral region 22.

As described, in the regenerative refrigerator of the fourth embodiment, the filling rate of the magnetic regenerative material 42 in the central region 21 is greater than the filling rate of the magnetic regenerative material 42 in the peripheral region 22 inside the low temperature region 26*b*. Therefore, inside the low temperature region 26*b*, the specific heat of the central region 21 is larger than the specific heat of the peripheral region 22.

In a manner similar to the regenerative refrigerator 1A of the first embodiment, the filling amount of the magnetic regenerative material 42 can be reduced without reducing a cooling efficiency of the second stage regenerator 26 of the regenerative refrigerator 1D of the fourth embodiment.

Figure 7B:
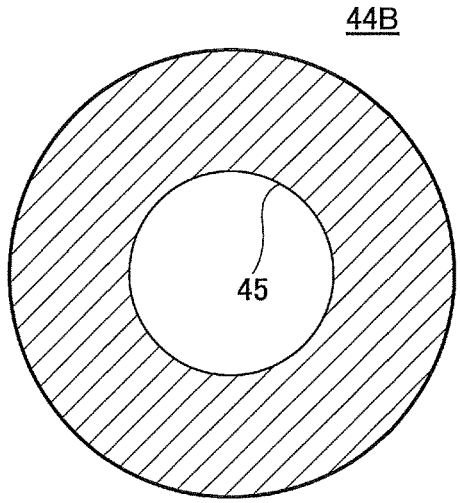
Figure 7C:
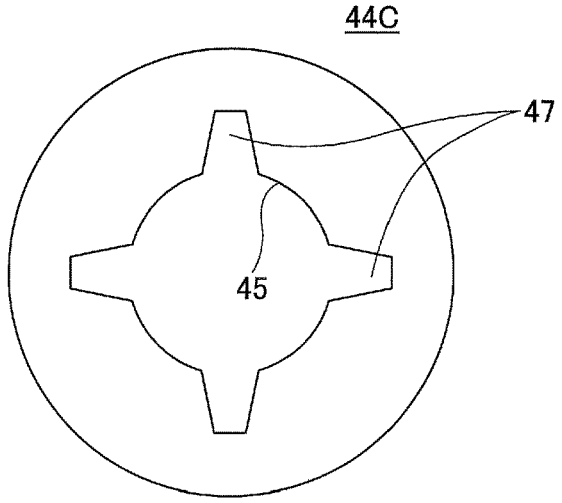

FIGS. 7B and 7C illustrate modified examples to the filler 44A illustrated in FIG. 7A. A filler 44B illustrated in FIG. 7B is formed of a metallic mesh. The structure of the metallic mesh is not specifically limited and can be appropriately selected in response to the specific heat and the filling rate of the desirable regenerative material.

A filler 44C illustrated in FIG. 7C is formed so that radiating openings 47 extend from the central hole 45 instead of the through holes 46 opened in the filler 44A. The radiating opening 47 is shaped like a trapezoid, of which lower base longer than the upper base is connected with the central hole 45. By appropriately selecting the shape of the radiating openings 47, the specific heat of the regenerative material inside the regenerator can be varied. The materials of the fillers 44B and 44C are preferably copper or a copper alloy having a high heat conductivity such as the filler 44A.

Although the outer shapes of the fillers 44B and 44C of the modified example illustrated in FIGS. 7B and 7C are like rings, the outer shape of the filler is not limited to the shape of a ring. For example, the outer shape of the filler may be a sphere, a cylindrical column, a rectangular solid, or the like.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the regenerative refrigerator has been described in detail, it should be understood that various changes, substitutions, and alterations could be made thereto without departing from the spirit and scope of the invention.

What is claimed is:

1. A regenerative refrigerator comprising:

a regenerator filled with a regenerative material for accumulating cooling of a refrigerant gas, wherein the regenerator is divided into a central region and a peripheral region on a cross-sectional face of the regenerator, wherein a specific heat of the central region is larger than a specific heat of the peripheral region, wherein the central region and the peripheral region are divided by a separating member, the separating member having a height along a longitudinal direction of the regenerative refrigerator that is less than an overall height of the regenerative material in the regenerator along the longitudinal direction of the regenerative refrigerator, wherein a magnetic regenerative material made of a magnetic material is provided only in the central region, and a nonmagnetic regenerative material made of a nonmagnetic material is provided in the peripheral region.

2. The regenerative refrigerator according to claim 1, wherein a flow path resistance for the refrigerant gas in the central region is less than a flow path resistance for the refrigerant gas in the peripheral region.

3. The regenerative refrigerator according to claim 1, wherein the separating member allows the refrigerant gas to pass through and prevents the regenerative material from passing through the separating member.

4. The regenerative refrigerator according to claim 1, wherein a ratio between cross-sectional areas of the central and peripheral regions is about 50% to about 95%.

5. The regenerative refrigerator according to claim 1, wherein the regenerator in the central region is formed by vertically arranging an upper portion and a lower portion positioned on a lower side of the upper portion, and wherein the upper portion is made of $HoCu_2$, and the lower portion is made of GOS ($Cd_2O_2S$).

6. The regenerative refrigerator according to claim 1, wherein another separating member is provided in an upper portion of the separating member so that the nonmagnetic regenerative material is not mixed with the magnetic regenerative material.

* * * * *